US011132901B2

(12) United States Patent
Shi et al.

(10) Patent No.: US 11,132,901 B2
(45) Date of Patent: Sep. 28, 2021

(54) PARKING LOT RECOMMENDATION METHOD AND NAVIGATION SERVER

(71) Applicant: BAIDU ONLINE NETWORK TECHNOLOGY (BEIJING) CO., LTD., Beijing (CN)

(72) Inventors: Wenli Shi, Beijing (CN); Tingting Ge, Beijing (CN); Xun Gan, Beijing (CN)

(73) Assignee: BAIDU ONLINE NETWORK TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 17/034,608

(22) Filed: Sep. 28, 2020

(65) Prior Publication Data

US 2021/0097861 A1 Apr. 1, 2021

(30) Foreign Application Priority Data

Sep. 29, 2019 (CN) ..... 201910934676.0

(51) Int. Cl.
*G08G 1/14* (2006.01)

(52) U.S. Cl.
CPC ..... *G08G 1/148* (2013.01)

(58) Field of Classification Search
None
See application file for complete search history.

(56) References Cited

U.S. PATENT DOCUMENTS

2009/0309761 A1* 12/2009 Nagase ..... G01C 21/3617 340/932.2
2016/0155276 A1* 6/2016 Ho ..... G07B 15/02 705/13

FOREIGN PATENT DOCUMENTS

| | | | |
|---|---|---|---|
| CN | 105096636 | A | 11/2015 |
| CN | 105844957 | A | 8/2016 |
| CN | 106169253 | A | 11/2016 |
| CN | 108133619 | A | 6/2018 |
| CN | 108140312 | A | 6/2018 |
| CN | 108140313 | A | 6/2018 |
| EP | 2075538 | A2 | 7/2009 |
| JP | 2007271397 | A | 10/2007 |

OTHER PUBLICATIONS

Chinese Patent Application No. 201910934676.0 First Office Action dated Jun. 11, 2020, 11 pages.
Chinese Patent Application No. 201910934676.0 English translation of First Office Action dated Jun. 11, 2020, 14 pages.

* cited by examiner

*Primary Examiner* — John F Mortell
(74) *Attorney, Agent, or Firm* — Lathrop GPM LLP

(57) ABSTRACT

The present disclosure provides a parking lot recommendation method, and a navigation server for determining a score of a candidate parking lot, based on a parking difficulty level of the candidate parking lot in an target area where a destination located, quantity of remaining parking spaces, walking distance from the candidate parking lot to the destination, and driving distance from a present position of a vehicle to the candidate parking lot, and selecting an object parking lot from the candidate parking lots existing in the target area, according to the score of the candidate parking lot, and providing parking lot information of the object parking lot to a navigation terminal.

20 Claims, 5 Drawing Sheets

PARKING LOT RECOMMENDATION METHOD AND NAVIGATION SERVER

CROSS REFERENCE TO RELATED APPLICATION

This application is based on and claims priority to Chinese patent application No. 201910934676.0, filed on Sep. 29, 2019, the entire content of which is hereby introduced into this application as a reference.

FIELD

The present disclosure relates to a computer technology field, and more particularly to a parking lot recommendation method and a navigation server.

BACKGROUND

With an increasing number of cars in various regions, users are driving more and more often. Moreover, in order to be convenient for the user to drive, various navigation products are becoming more and more common. The user can go everywhere by navigation at any time.

SUMMARY

Embodiments of the present disclosure provide a parking lot recommendation method. The method includes: determining a target area according to a destination when a vehicle using a navigation terminal approaches the destination, wherein, the target area includes multiple candidate parking lots; for each candidate parking lot, acquiring a parking difficulty level of the candidate parking lot corresponding to a present time period, wherein, the parking difficulty level is determined according to a first average parking time-consumption of the candidate parking lot corresponding to the present time period, and a second average parking time-consumption of the target area corresponding to the present time period; determining a score of the candidate parking lot according to the parking difficulty level, a number of present remaining parking spaces of the candidate parking lot, a walking distance from the candidate parking lot to the destination, and a driving distance from a present position of the vehicle to the candidate parking lot; determining a target parking lot from the multiple candidate parking lots according to the scores of the multiple candidate parking lots; and returning parking lot information of the target parking lot to the navigation terminal.

Embodiments of the present disclosure provide a navigation server. The navigation server includes: at least one processor; and a memory in communication connection with at least one processor. The memory is stored with instructions executable by the at least one processor. When the instructions are executed by the at least one processor, a parking lot recommendation method of embodiments of the present disclosure is implemented by the at least one processor, the parking lot recommendation method includes: determining a target area according to a destination when a vehicle using a navigation terminal approaches the destination, wherein, the target area includes multiple candidate parking lots; for each candidate parking lot, acquiring a parking difficulty level of the candidate parking lot corresponding to a present time period, wherein, the parking difficulty level is determined according to a first average parking time-consumption of the candidate parking lot corresponding to the present time period, and a second average parking time-consumption of the target area corresponding to the present time period; determining a score of the candidate parking lot according to the parking difficulty level, a number of present remaining parking spaces of the candidate parking lot, a walking distance from the candidate parking lot to the destination, and a driving distance from a present position of the vehicle to the candidate parking lot; determining a target parking lot from the multiple candidate parking lots according to the scores of the multiple candidate parking lots; and returning parking lot information of the target parking lot to the navigation terminal.

Embodiments of the present disclosure provide a parking lot recommendation method. The method includes: determining a target area according to a destination when a vehicle using a navigation terminal approaches the destination, wherein, the target area includes multiple candidate parking lots; for each candidate parking lot, determining a score of the candidate parking lot according to scoring parameters of the candidate parking lot, wherein, the scoring parameters include a first average parking time-consumption of the candidate parking lot corresponding to a present time period, and a second average parking time-consumption of the target area corresponding to the present time period; determining a target parking lot from the multiple candidate parking lots according to the scores of the multiple candidate parking lots; and returning parking lot information of the target parking lot to the navigation terminal.

Other effects of the above alternative implementations will be illustrated in the following in combination with detailed embodiments.

BRIEF DESCRIPTION OF THE DRAWINGS

The drawings are used to better understand the solution, and do not constitute a limitation to the present disclosure, in which.

DETAILED DESCRIPTION

Referring to the following drawings, illustration will be made to exemplary embodiments of the present disclosure, in which various details of the embodiments of the present disclosure are included for facilitating understanding, and they should be considered as merely exemplary. Therefore, it would be appreciated by those skilled in the art that various changes and modifications can be made to the embodiments described here, without departing from spirit and scope of the present disclosure. As well, for clarity and brevity, in the following description, description of well-known functions and structures are omitted.

A parking lot recommendation method, a parking lot recommendation apparatus and a navigation server of embodiments of the present disclosure are described below with reference to drawings.

Figure 1:
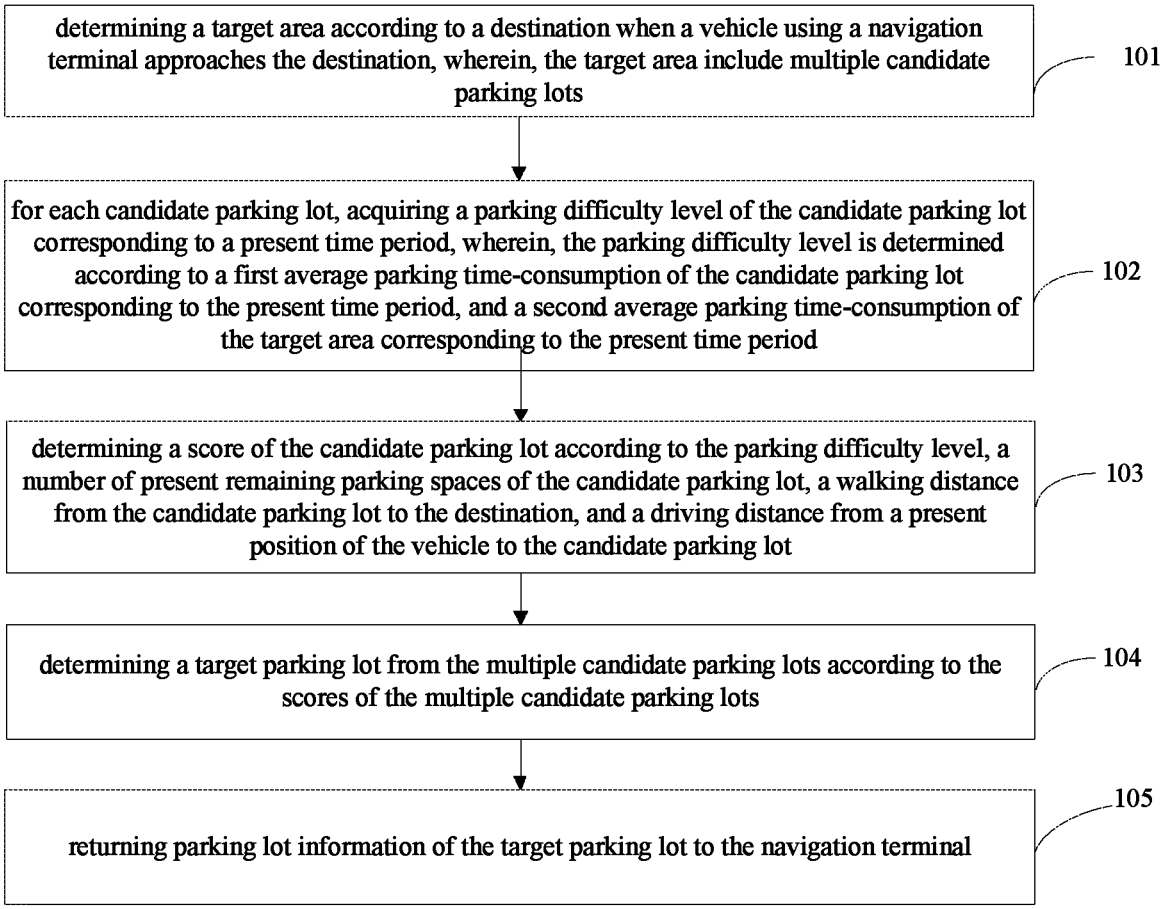
FIG. 1 is a schematic diagram of a parking lot recommendation method according to a first embodiment of the present disclosure.

FIG. 1 is a schematic diagram of a parking lot recommendation method according to a first embodiment of the present disclosure. It is to be noted that the executive body of the parking lot recommendation method provided by this embodiment is a parking lot recommendation apparatus. The apparatus may be implemented in form of software and/or hardware. In this embodiment, illustration is given with the apparatus configured in a navigation server as an example.

As illustrated in FIG. 1, the parking lot recommendation method may include acts in the following blocks.

At block 101, a target area is determined according to a destination when a vehicle using a navigation terminal approaches the destination, in which, the target area includes multiple candidate parking lots.

It can be understood that the target area in this embodiment is an area including the destination, and there are many ways to determine the target area. For example, when the vehicle using the navigation terminal approaches the destination, the target area may be formed with the destination as a center of a circle and a preset radius, in combination with navigation map information.

In this embodiment, in a process of a user of the vehicle using navigation to drive, the navigation server may detect a present position of the vehicle in real time, and may also determine whether the navigation vehicle approaches the destination.

The navigation terminal in this embodiment may be an on-board navigation device in the vehicle, or an intelligent mobile terminal placed in the vehicle, such as, a smartphone or a tablet PC placed in the vehicle, in which the intelligent mobile terminal has a navigation function.

At block 102, for each candidate parking lot, a parking difficulty level of the candidate parking lot corresponding to a present time period is acquired, in which, the parking difficulty level is determined according to a first average parking time-consumption of the candidate parking lot corresponding to the present time period, and a second average parking time-consumption of the target area corresponding to the present time period.

In detail, an estimated time point of the vehicle arriving at the destination is determined according to the present position of the vehicle, and the present time period is determined according to the estimated time point. For example, the estimated time point of the vehicle arriving at the destination is 8:40, and then the present time period corresponding to the estimated time point is 8:30-9:00.

The first average parking time-consumption represents an average time-consumption required for the vehicle to park in the candidate parking lot in the present time period.

The second average parking time-consumption represents an average time-consumption required for the vehicle to park in the target area in the present time period.

In this embodiment, the first average parking time-consumption of the candidate parking lot corresponding to the present time period may be determined as follows. The first average parking time-consumption of the candidate parking lot corresponding to the present time period is acquired by querying pre-stored average parking time-consumptions of the candidate parking lot in respective time periods.

In this embodiment, in order to accurately determine the average parking time-consumptions of the candidate parking lot in respective time periods, before acquiring the first average parking time-consumption of the candidate parking lot corresponding to the present time period, the average parking time-consumptions of the candidate parking lot in respective time periods may also be determined in combination with historical parking data of the candidate parking lot in respective time periods.

Figure 2:
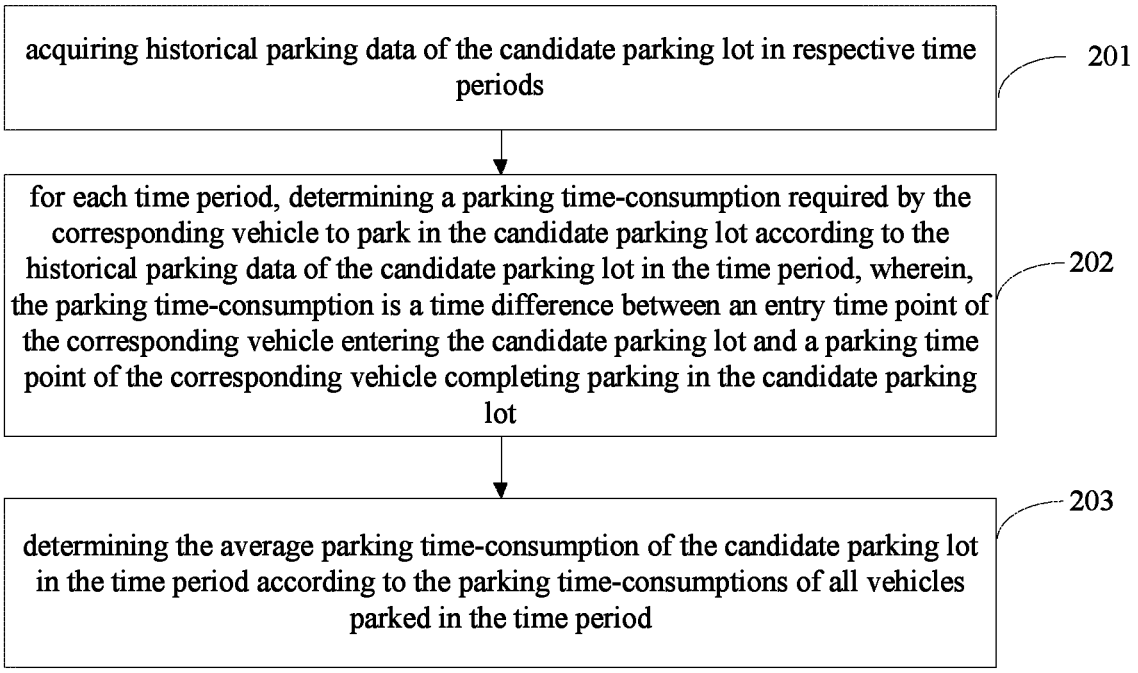
FIG. 2 is a schematic diagram of a method for determining an average parking time-consumption of a candidate parking lot in each time period according to embodiments of the present disclosure.

As illustrated in FIG. 2, details of a method for determining the average parking time-consumptions of the candidate parking lot in respective time periods may include the following.

At block 201, historical parking data of the candidate parking lot in respective time periods is acquired.

At block 202, for each time period, a parking time-consumption required by the corresponding vehicle to park in the candidate parking lot is determined according to the historical parking data of the candidate parking lot in the time period, in which the parking time-consumption is a time difference between an entry time point of the corresponding vehicle entering the candidate parking lot and a parking time point of the corresponding vehicle completing parking in the candidate parking lot.

In this embodiment, in order to accurately determine the parking time-consumption, and reduce cost of the parking lot determining whether the vehicle completes the parking, the parking time-consumption required by the vehicle to park in the candidate parking lot is determined in combination with a vehicle entry record uploaded by a parking lot terminal in the candidate parking lot, and a parking record uploaded by the navigation terminal when detecting that the corresponding vehicle completes the parking in the candidate parking lot. The vehicle entry record includes the entry time point when the vehicle enters the candidate parking lot, and the parking record include the parking time point when the vehicle completes parking in the candidate parking lot.

As an example, when a driving user passes a barrier gate of the candidate parking lot, the parking lot terminal uploads the vehicle entry record to a log processing module, and at this time, the entry time point T1 of the vehicle is recorded. When the vehicle is finally parked at a certain parking space and then stalled by the user, the navigation terminal uploads the parking time point to the log processing module, and the parking time point T2 of the vehicle is recorded. The parking time-consumption required by the vehicle to park in the candidate parking lot may be calculated according to the time difference between the parking time point T2 and the entry time point T1.

At block 203, the average parking time-consumption of the candidate parking lot in the time period is determined according to the parking time-consumptions of all vehicles parked in the time period.

In different application scenes, there may be different ways to determine the second average parking time-consumption of the target area corresponding to the present time period, which are illustrated as follows.

As an example, the second average parking time-consumption may be determined according to the first average parking time-consumptions of respective candidate parking lots. Thus, it is convenient to determine the second average parking time-consumption.

In detail, an averaging processing is performed on the first average parking time-consumptions of respective candidate parking lots, and a result of the averaging processing is the second average parking time-consumption of the target area corresponding to the present time period.

For instance, there are three candidate parking lots in the target area of the destination, which are candidate parking lot A, candidate parking lot B and candidate parking lot C respectively. Suppose the present time period is 9 o'clock-10 o'clock, the average parking time-consumption required by parking in the candidate parking lot A is 3 minutes, the average parking time-consumption required by parking in the candidate parking lot B is 4 minutes, and the average parking time-consumption required by parking in the candidate parking lot C is 5 minutes, then, according to the average parking time-consumptions of the three parking lots, it may be calculated that the average parking time-consumption required for the vehicle to park in the target area between 9 and 10 o'clock is 4 minutes.

As another example, the average parking time-consumption of the target area corresponding to the present time period may be acquired by querying pre-stored average parking time-consumptions of the target area in the respective time periods.

As another example, the average parking time-consumption of the target area corresponding to the present time period may be determined according to historical parking data of the target area corresponding to the present time period.

At block 103, a score of the candidate parking lot is determined according to the parking difficulty level, a number of present remaining parking spaces of the candidate parking lot, a walking distance from the candidate parking lot to the destination, and a driving distance from a present position of the vehicle to the candidate parking lot.

It can be understood that in different application scenes, there are multiple specific implementations of the action in block 103, illustrations of which are as follows.

As an example, the score of the candidate parking lot may be obtained by performing a weighted summation on the parking difficulty level of the candidate parking lot, the number of the present remaining parking spaces of the candidate parking lot, the walking distance from the candidate parking lot to the destination, and the driving distance from the present position of the vehicle to the candidate parking lot.

As an exemplary implementation, in order to make the recommended target parking lot more suitable for user's requirement, the weights of respective factors may be determined based on degree of user's attention to the above factors such as the parking difficulty level, the number of the present remaining parking spaces, the walking distance and the driving distance.

As another example, the parking difficulty level, the number of the present remaining parking spaces of the candidate parking lot, the walking distance from the candidate parking lot to the destination, and the driving distance from the present position of the vehicle to the candidate parking lot may be inputted into a pre-trained scoring model, to obtain the score of the candidate parking lot.

In this embodiment, in order to enable the scoring model to accurately calculate the score of the corresponding parking lot, the scoring model may be trained in combination with the parking difficulty level of a sample parking lot, the number of the remaining parking spaces of the sample parking lot, the walking distance from the sample parking lot to the destination, the driving distance from the present position of the vehicle to the sample parking lot, and score label data of the sample parking lot.

At block 104, a target parking lot is determined from the multiple candidate parking lots according to the scores of the multiple candidate parking lots.

In this embodiment, description is made in an example in which the higher the score of the candidate parking lot, the more suitable for parking in the corresponding candidate parking lot.

As a possible implementation, after the score of each candidate parking lot is acquired, the multiple candidate parking lots may be ranked according to the scores from the highest to the lowest, and the candidate parking lot ranked first is determined as the target parking lot.

As another possible implementation, after the score of each candidate parking lot is acquired, the candidate parking lot with the highest score is determined as the target parking lot.

At block 105, parking lot information of the target parking lot is returned to the navigation terminal.

In this embodiment, in order to provide abundant parking lot information to the user for effectively guiding the user to park, the parking lot information of the target parking lot may include, but is not limited to, position information of the target parking lot, the average parking time-consumption of the target parking lot corresponding to the present time period, the number of the present remaining parking spaces of the target parking lot, the walking distance from the target parking lot to the destination, and the driving distance from the present position of the vehicle to the target parking lot.

Accordingly, the navigation terminal displays the parking lot information of the target parking lot sent by the navigation server.

In this embodiment, in order to conveniently and quickly reach the target parking lot, when a confirmation command for the target parking lot sent by the navigation terminal is received, a navigation path may be generated according to the present position of the vehicle and the position of the target parking lot, and returned to the navigation terminal. Thus, it is convenient for the user to quickly reach the target parking lot for parking, according to the navigation path returned by the navigation server.

In this embodiment, in order to further meet the requirement of the user to select the parking lot personally, the parking information of the remaining candidate parking lots around the destination may also be returned to the navigation terminal while returning the parking lot information of the target parking lot to the navigation terminal.

In this embodiment, in order to be convenient for the user to understand time-consumption information required by parking in an area where the destination is located, the average parking time-consumption of the target parking lot corresponding to the present time period may also be returned to the navigation terminal, so that the user understands the time-consumption information required by parking in the area through the navigation terminal.

With the parking lot recommendation method of embodiments of the present disclosure, the score of the candidate parking lot is determined based on the parking difficulty level of the candidate parking lot in the target area where the destination is located, the number of the remaining parking spaces, the walking distance from the candidate parking lot to the destination, and the driving distance from the present position of the vehicle to the candidate parking lot together, and the target parking lot is selected from the candidate parking lots existing in the target area according to the scores of the candidate parking lots, and the parking lot information of the target parking lot is provided to the navigation terminal. Therefore, the parking lot is recommended to the user based on various factors such as the parking difficulty level, the number of the present remaining parking spaces, the walking distance, and the driving distance, thereby improving the accuracy of recommending the parking lot, being convenient for the user to park according to the target parking lot provided in the navigation terminal.

Figure 3:
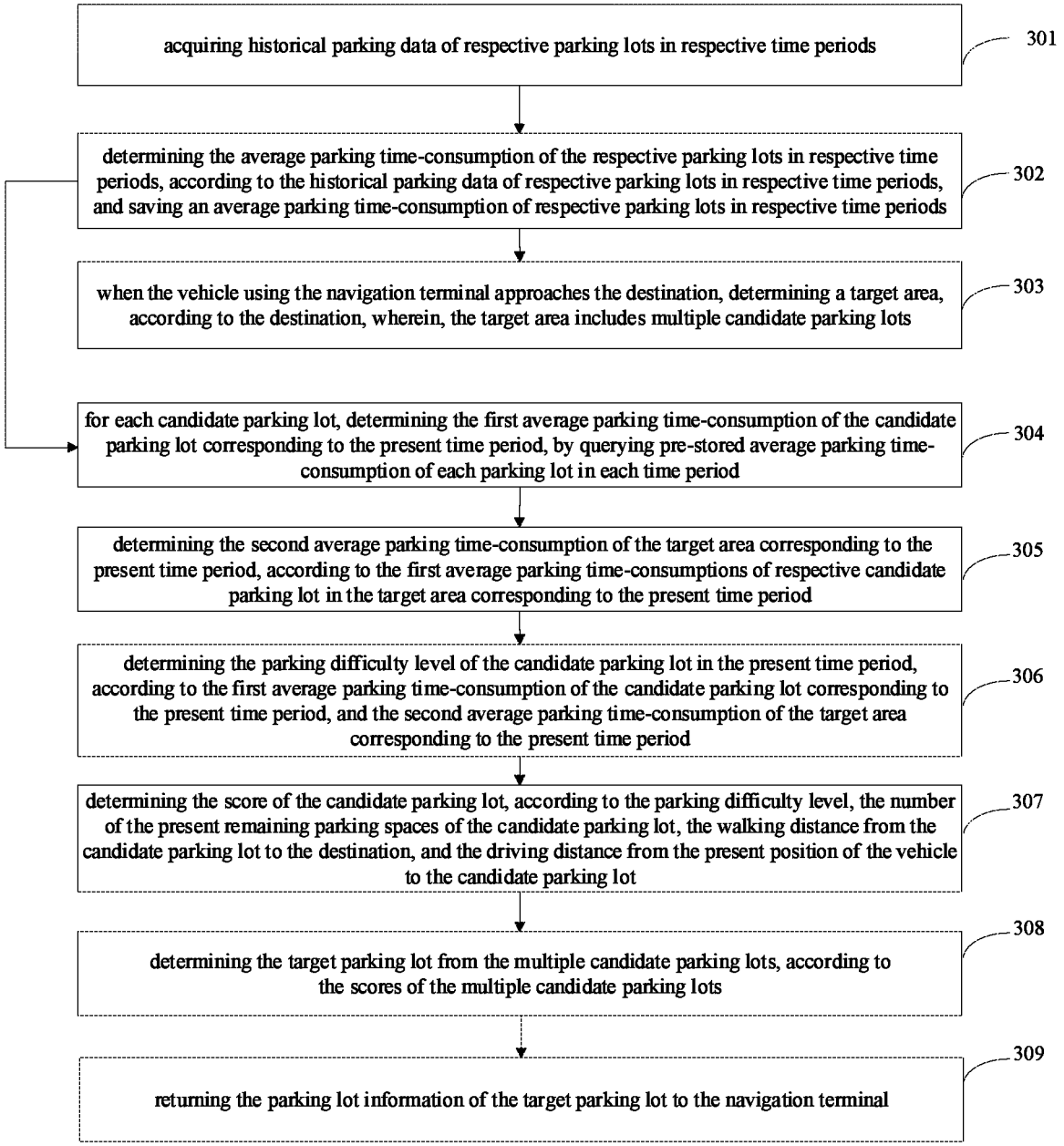
FIG. 3 is a schematic diagram of a parking lot recommendation method according to a second embodiment of the present disclosure.

FIG. 3 is a schematic diagram of a parking lot recommendation method according to a second embodiment of the present disclosure. It is to be noted that the second embodiment illustrates further details or optimization of the first embodiment.

As illustrated in FIG. 3, the parking lot recommendation method may include acts in the following blocks.

At block 301, historical parking data of respective parking lots in respective time periods is acquired.

At block 302, the average parking time-consumptions of the respective parking lots in respective time periods are determined according to the historical parking data of respective parking lots in respective time periods, and the average parking time-consumptions of respective parking lots in respective time periods are saved.

At block 303, when the vehicle using the navigation terminal approaches the destination, a target area is determined according to the destination, wherein, the target area includes multiple candidate parking lots.

At block 304, for each candidate parking lot, the first average parking time-consumption of the candidate parking lot corresponding to the present time period is determined by querying the pre-stored average parking time-consumptions of respective parking lots in respective time periods.

At block 305, the second average parking time-consumption of the target area corresponding to the present time period is determined according to the first average parking time-consumptions of respective candidate parking lots in the target area corresponding to the present time period.

In detail, the averaging processing is performed on the first average parking time-consumptions of respective candidate parking lots in the target area corresponding to the present time period, and the result of the averaging processing is the second average parking time-consumption of the target area corresponding to the present time period.

At block 306, the parking difficulty level of the candidate parking lot in the present time period is determined according to the first average parking time-consumption of the candidate parking lot corresponding to the present time period, and the second average parking time-consumption of the target area corresponding to the present time period.

As a possible implementation, the first average parking time-consumption may be compared with the second average parking time-consumption. If the first average parking time-consumption is greater than the second average parking time-consumption, then parking in the candidate parking lot is determined as difficult, and the parking difficulty level of the candidate parking lot is determined according to the time difference between the first average parking time-consumption and the second average parking time-consumption.

In addition, if the first average parking time-consumption is less than the second average parking time-consumption, then parking in the candidate parking lot is determined as easy, and the parking difficulty level of the candidate parking lot is determined according to the time difference between the first average parking time-consumption and the second average parking time-consumption. For example, the smaller the value of the parking difficulty level is, the more difficult the parking is, and the larger the value of the parking difficulty level is, the less difficult the parking is.

At block 307, the score of the candidate parking lot is determined according to the parking difficulty level, the number of the present remaining parking spaces of the candidate parking lot, the walking distance from the candidate parking lot to the destination, and the driving distance from the present position of the vehicle to the candidate parking lot.

In detail, the score of the candidate parking lot may be obtained by performing a weighted summation on the parking difficulty level of the candidate parking lot, the number of the present remaining parking spaces of the candidate parking lot, the walking distance from the candidate parking lot to the destination, and the driving distance from the present position of the vehicle to the candidate parking lot.

In this embodiment, description is made in an example in which the higher the score of the candidate parking lot, the more suitable for parking in the corresponding candidate parking lot.

At block 308, the target parking lot is determined from the multiple candidate parking lots according to the scores of the multiple candidate parking lots.

At block 309, the parking lot information of the target parking lot is returned to the navigation terminal.

With the parking lot recommendation method of embodiments of the present disclosure, the score of the candidate parking lot is determined based on the parking difficulty level of the candidate parking lot in the target area where the destination is located, the number of the remaining parking spaces, the walking distance from the candidate parking lot to the destination, and the driving distance from the present position of the vehicle to the candidate parking lot together, and the target parking lot is selected from the candidate parking lots existing in the target area according to the scores of the candidate parking lots, and the parking lot information of the target parking lot is provided to the navigation terminal. Therefore, the parking lot is recommended to the user based on various factors such as the parking difficulty level, the number of the present remaining parking spaces, the walking distance, and the driving distance, thereby improving the accuracy of recommending the parking lot, being convenient for the user to park according to the target parking lot provided in the navigation terminal.

In order to implement the above embodiments, embodiments of the present disclosure also provide a parking lot recommendation apparatus.

Figure 4:
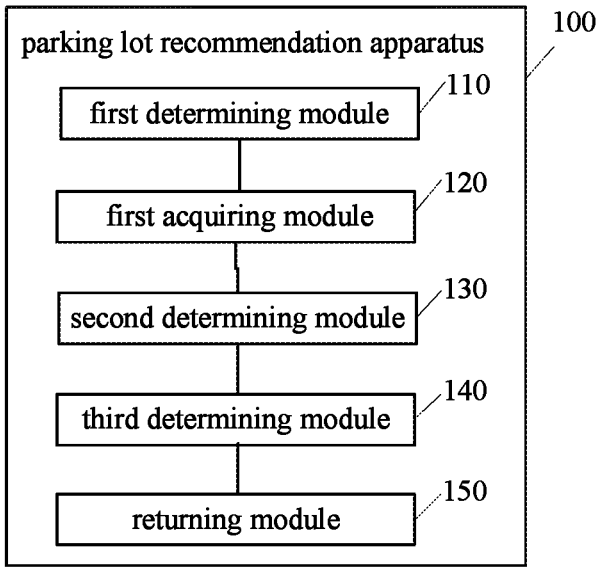
FIG. 4 is a schematic diagram of a parking lot recommendation apparatus according to a third embodiment of the present disclosure.

FIG. 4 is a schematic diagram of a parking lot recommendation apparatus according to a third embodiment of the present disclosure. As illustrated in FIG. 4, the parking lot recommendation apparatus 100 includes a first determining module 110, a first acquiring module 120, a second determining module 130, a third determining module 140, and a returning module 150.

The first determining module 110 is configured to determine a target area according to a destination when a vehicle using a navigation terminal approaches the destination, wherein, the target area includes multiple candidate parking lots.

The first acquiring module 120 is configured to, for each candidate parking lot, acquire a parking difficulty level of the candidate parking lot corresponding to a present time period, wherein, the parking difficulty level is determined according to a first average parking time-consumption of the candidate parking lot corresponding to the present time period, and a second average parking time-consumption of the target area corresponding to the present time period.

The second determining module 130 is configured to determine a score of the candidate parking lot according to the parking difficulty level, a number of present remaining parking spaces of the candidate parking lot, a walking distance from the candidate parking lot to the destination, and a driving distance from a present position of the vehicle to the candidate parking lot.

The third determining module 140 is configured to determine a target parking lot from the multiple candidate parking lots according to the scores of the multiple candidate parking lots.

The returning module 150 is configured to return parking lot information of the target parking lot to the navigation terminal.

Figure 5:
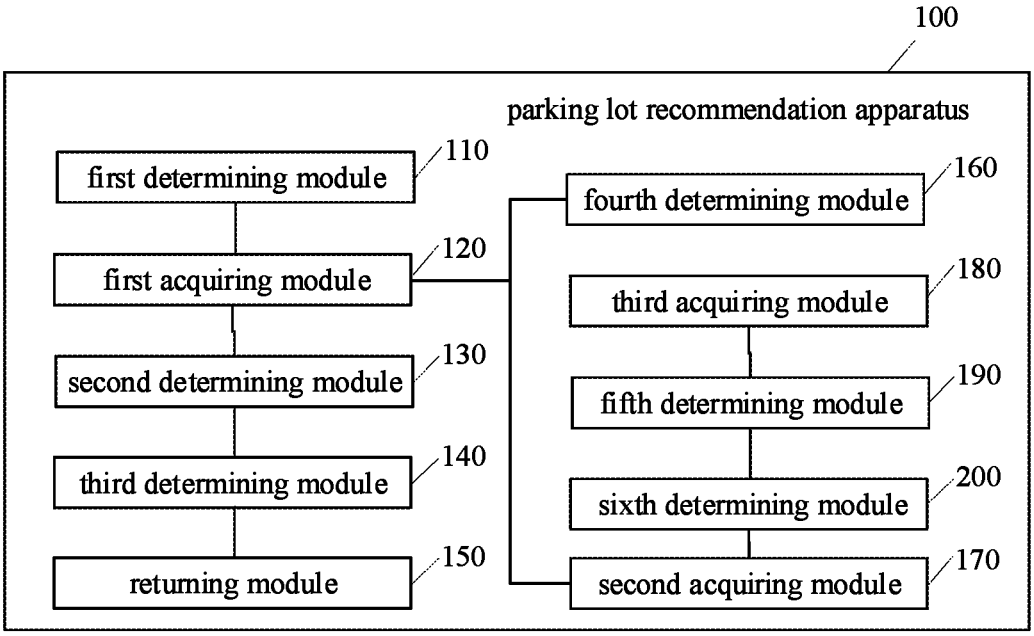
FIG. 5 is a schematic diagram of a parking lot recommendation apparatus according to a fourth embodiment of the present disclosure.

In an embodiment, based on the embodiment illustrated in FIG. 4, as illustrated in FIG. 5, the apparatus 100 further includes a fourth determining module 160.

The fourth determining module 160 is configured to determine the second average parking time-consumption according to the first average parking time-consumptions of respective candidate parking lots.

In an embodiment, as illustrated in FIG. 5, the apparatus 100 further includes a second acquiring module 170. The second acquiring module 170 is configured to acquire the first average parking time-consumption of the candidate parking lot corresponding to the present time period by querying pre-stored average parking time-consumptions of the candidate parking lot in respective time periods.

In an embodiment, as illustrated in FIG. 5, the apparatus 100 further includes a third acquiring module 180, a fifth determining module 190, and a sixth determining module 200.

The third acquiring module 180 is configured to acquire historical parking data of the candidate parking lot in respective time periods.

The fifth determining module 190 is configured to, for each time period, determine a parking time-consumption required by the corresponding vehicle to park in the candidate parking lot according to the historical parking data of the candidate parking lot in the time period, in which the parking time-consumption is a time difference between an entry time point when the corresponding vehicle enters the candidate parking lot and a parking time point when the corresponding vehicle completes parking in the candidate parking lot.

The sixth determining module 200 is configured to determine the average parking time-consumption of the candidate parking lot in the time period according to the parking time-consumptions of all vehicles parked in the time period.

In an embodiment, the entry time point is uploaded by a parking lot terminal in the candidate parking lot, and the parking time point is uploaded by the navigation terminal when detecting that the corresponding vehicle completes the parking in the candidate parking lot.

It should be noted that the aforesaid explanation and description of the parking lot recommendation method is also suitable for the parking lot recommendation apparatus, and will not be repeated here.

With the parking lot recommendation apparatus of embodiments of the present disclosure, the score of the candidate parking lot is determined based on the parking difficulty level of the candidate parking lot in the target area where the destination is located, the number of the remaining parking spaces, the walking distance from the candidate parking lot to the destination, and the driving distance from the present position of the vehicle to the candidate parking lot together, and the target parking lot is selected from the candidate parking lots existing in the target area according to the scores of the candidate parking lots, and the parking lot information of the target parking lot is provided to the navigation terminal. Therefore, the parking lot is recommended to the user based on various factors such as the parking difficulty level, the number of the present remaining parking spaces, the walking distance, and the driving distance, thereby improving the accuracy of recommending the parking lot, being convenient for the user to park according to the target parking lot provided in the navigation terminal.

According to embodiments of this disclosure, this disclosure also provides a navigation server and a readable storage medium.

Figure 6:
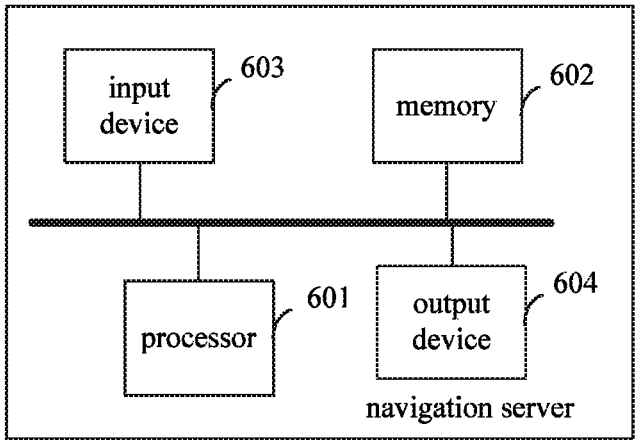
FIG. 6 is a block diagram of a navigation server according to embodiments of the present disclosure.

FIG. 6 is a block diagram of a navigation server according to embodiments of the present disclosure. The navigation server is intended to represent various forms of digital computers, such as a laptop computer, a desktop computer, a workbench, a personal digital assistant, a server, a blade server, a mainframe computer and other suitable computers. The navigation server may also represent various forms of mobile devices, such as a personal digital processor, a cellular phone, a smart phone, a wearable device and other similar computing devices. Components shown herein, their connections and relationships as well as their functions are merely examples, and are not intended to limit the implementation of the present disclosure described and/or required herein.

As illustrated in FIG. 6, the navigation server includes: one or more processors 601, a memory 602, and interfaces for connecting various components, including a high-speed interface and a low-speed interface. The components are interconnected by different buses and may be mounted on a common motherboard or otherwise installed as required. The processor may process instructions executed within the navigation server, including instructions stored in or on the memory to display graphical information of the GUI (Graphical User Interface) on an external input/output device (such as a display device coupled to the interface). In other embodiments, when necessary, multiple processors and/or multiple buses may be used together with multiple memories. Similarly, multiple navigation servers may be connected, each providing some of the necessary operations (for example, as a server array, a group of blade servers, or a multiprocessor system). One processor 601 is taken as an example in FIG. 6.

The memory 602 is a non-transitory computer-readable storage medium according to the embodiments of the present disclosure. The memory stores instructions executable by at least one processor, so that the at least one processor implements the parking lot recommendation method provided by the present disclosure. The non-transitory computer-readable storage medium according to the present disclosure stores computer instructions, which are configured to make the computer implement the parking lot recommendation method provided by the present disclosure.

As a non-transitory computer-readable storage medium, the memory 602 may be configured to store non-transitory software programs, non-transitory computer executable programs and modules, such as program instructions/modules (for example, the first determining module 110, the first acquiring module 120, the second determining module 130, the third determining module 140, and the returning module 150 illustrated in FIG. 4) corresponding to the parking lot recommendation method according to the embodiments of the present disclosure. The processor 601 performs various functional applications and data processing of the server, i.e., implements the parking lot recommendation method according to the foregoing method embodiments, by running the non-transitory software programs, instructions and modules stored in the memory 602.

The memory 602 may include a program memory area and a data memory area, where the program memory area may store an operating system and applications required for at least one function; and the data memory area may store data created according to the use of navigation server that implements the parking lot recommendation, and the like. In addition, the memory 602 may include a high-speed random access memory, and may further include a non-transitory memory, such as at least one magnetic disk memory, a flash memory device, or other non-transitory solid-state memories. In some embodiments, the memory 602 may optionally include memories remotely disposed with respect to the processor 601, and these remote memories may be connected to the navigation server that implements the parking lot recommendation through a network. Examples of the network include, but are not limited to, the Internet, an intranet, a local area network, a mobile communication network, and combinations thereof.

The navigation server configured to implement the parking lot recommendation method may further include an input device 603 and an output device 604. The processor 601, the memory 602, the input device 603 and the output device 604 may be connected through a bus or in other manners. FIG. 6 is illustrated by taking the connection through a bus as an example.

The input device 603 may receive input numeric or character information, and generate key signal inputs related to user settings and function control of the navigation server configured to implement the parking lot recommendation, such as a touch screen, a keypad, a mouse, a trackpad, a touchpad, a pointing stick, one or more mouse buttons, trackballs, joysticks and other input devices. The output device 604 may include a display device, an auxiliary lighting device (for example, an LED), a haptic feedback device (for example, a vibration motor), and so on. The display device may include, but is not limited to, a liquid crystal display (LCD), a light emitting diode (LED) display and a plasma display. In some embodiments, the display device may be a touch screen.

Various implementations of systems and technologies described herein may be implemented in digital electronic circuit systems, integrated circuit systems, application-specific ASICs (application-specific integrated circuits), computer hardware, firmware, software, and/or combinations thereof. These various implementations may include being implemented in one or more computer programs that are executable and/or interpretable on a programmable system including at least one programmable processor. The programmable processor may be a dedicated or general-purpose programmable processor that may receive data and instructions from a storage system, at least one input device and at least one output device, and transmit the data and instructions to the storage system, the at least one input device and the at least one output device.

These computing programs (also known as programs, software, software applications, or codes) include machine instructions of a programmable processor, and may be implemented by utilizing high-level procedures and/or object-oriented programming languages, and/or assembly/machine languages. As used herein, terms "machine-readable medium" and "computer-readable medium" refer to any computer program product, device and/or apparatus (for example, a magnetic disk, an optical disk, a memory and a programmable logic device (PLD)) configured to provide machine instructions and/or data to the programmable processor, and includes machine-readable media that receive machine instructions as machine-readable signals. The term "machine-readable signals" refers to any signal used to provide machine instructions and/or data to the programmable processor.

In order to provide interactions with the user, the systems and technologies described herein may be implemented on a computer having a display device (for example, a cathode ray tube (CRT) or a liquid crystal display (LCD) monitor) for displaying information to the user, and a keyboard and a pointing device (such as a mouse or trackball) through which the user may provide input to the computer. Other kinds of devices may also be used to provide interactions with the user. For example, the feedback provided to the user may be any form of sensory feedback (e.g., visual feedback, auditory feedback or haptic feedback), and input from the user may be received in any form (including acoustic input, voice input or tactile input).

The systems and technologies described herein may be implemented in a computing system that includes back-end components (for example, as a data server), a computing system that includes middleware components (for example, an application server), or a computing system that includes front-end components (for example, a user computer with a graphical user interface or a web browser, through which the user may interact with the implementation of the systems and technologies described herein), or a computing system including any combination of the back-end components, the middleware components or the front-end components. The components of the system may be interconnected by digital data communication (e.g., a communication network) in any form or medium. Examples of the communication network include a local area network (LAN), a wide area network (WAN), and the Internet.

The computer system may include a client and a server. The client and server are generally remote from each other and typically interact through the communication network. A client-server relationship is generated by computer programs running on respective computers and having a client-server relationship with each other.

Figure 7:
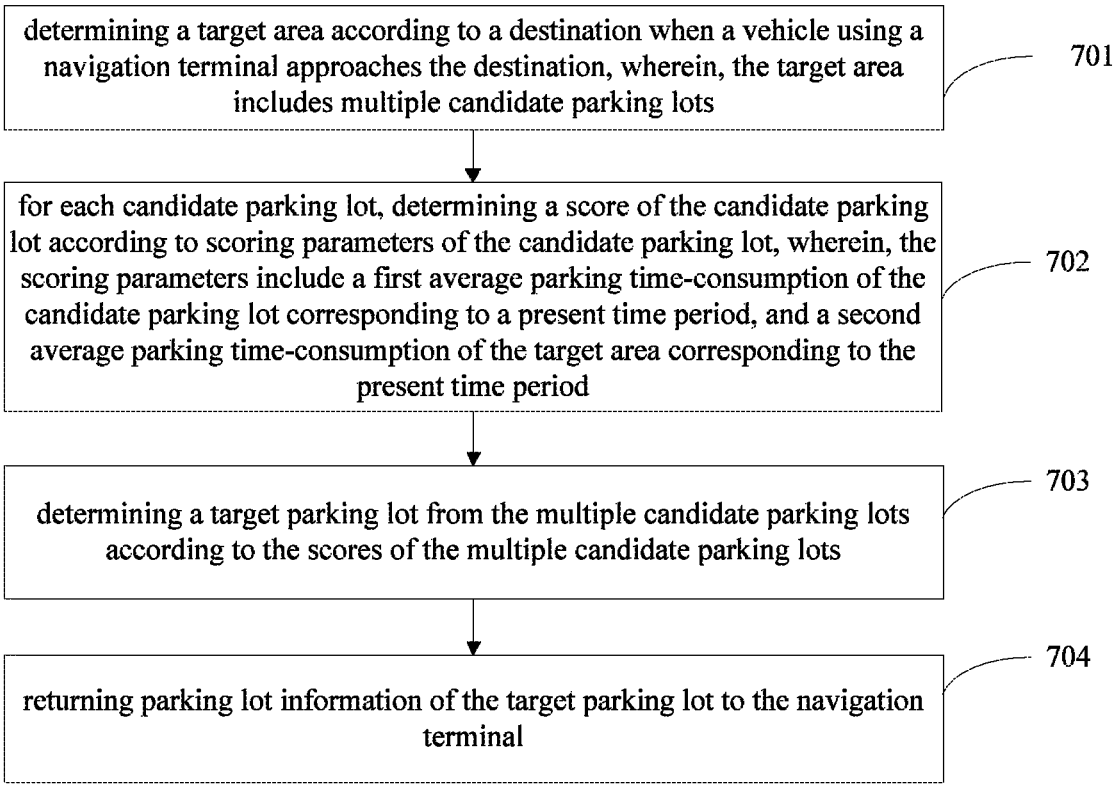
FIG. 7 is a schematic diagram of a parking lot recommendation method according to a fifth embodiment of the present disclosure.

FIG. 7 is a schematic diagram of a parking lot recommendation method according to a fifth embodiment of the present disclosure. It is to be noted that the executive body of the parking lot recommendation method provided by this embodiment is the parking lot recommendation apparatus. The apparatus may be implemented in form of software and/or hardware, and the apparatus may be configured in a navigation server.

As illustrated in FIG. 7, the parking lot recommendation method may include acts in the following blocks.

At block 701, a target area is determined according to a destination when a vehicle using a navigation terminal approaches the destination, wherein, the target area includes multiple candidate parking lots.

At block 702, for each candidate parking lot, a score of the candidate parking lot is determined according to scoring parameters of the candidate parking lot, wherein, the scoring parameters include a first average parking time-consumption of the candidate parking lot corresponding to a present time period, and a second average parking time-consumption of the target area corresponding to the present time period.

In this embodiment, in order to further improve an accuracy of calculating the candidate parking lot, the above scoring parameters may also include a number of present remaining parking spaces in the candidate parking lot, a walking distance from the candidate parking lot to the destination, and a driving distance from a present position of the vehicle to the candidate parking lot.

As an exemplary implementation, the score of the candidate parking lot may be determined according to the first average parking time-consumption, the second average parking time-consumption, the number of the present remaining parking spaces in the candidate parking lot, the walking distance from the candidate parking lot to the destination, and the driving distance from the present position of the vehicle to the candidate parking lot.

There are multiple specific implementations of determining the score of the candidate parking lot according to the first average parking time-consumption, the second average parking time-consumption, the number of the present remaining parking spaces in the candidate parking lot, the walking distance from the candidate parking lot to the destination, and the driving distance from the present position of the vehicle to the candidate parking lot. For example, the score of the candidate parking lot may be obtained by performing weighted summation on the first average parking time-consumption, the second average parking time-consumption, the number of the present remaining parking spaces of the candidate parking lot, the walking distance from the candidate parking lot to the destination, and the driving distance from the present position of the vehicle to the candidate parking lot.

At block 703, a target parking lot is determined from the multiple candidate parking lots according to the scores of the multiple candidate parking lots.

At block 704, parking lot information of the target parking lot is returned to the navigation terminal.

With the parking lot recommendation method of embodiments of the present disclosure, the score of the candidate parking lot is determined based on the parking difficulty level of the candidate parking lot in the target area where the destination is located, the number of the remaining parking spaces, the walking distance from the candidate parking lot to the destination, and the driving distance from the present position of the vehicle to the candidate parking lot together, and the target parking lot is selected from the candidate parking lots existing in the target area according to the scores of the candidate parking lots, and the parking lot information of the target parking lot is provided to the navigation terminal. Therefore, the parking lot is recommended to the user based on various factors such as the parking difficulty level, the number of the present remaining parking spaces, the walking distance, and the driving distance, thereby improving the accuracy of recommending the parking lot, being convenient for the user to park according to the target parking lot provided in the navigation terminal.

It should be noted that the aforesaid explanation and description of the above-mentioned parking lot recommendation method is also suitable for the parking lot recommendation method of this embodiment, and for relevant description, reference may be made to the relevant part, which will not be repeated here.

It should be understood, various forms of the process illustrated above may be used, in which steps may be reordered, added or removed. For example, respective steps described in the present disclosure may be executed in parallel, or executed sequentially, or executed in different sequence, as long as a desired result of the technical solution disclosed in the present disclosure can be realized, which are not limited herein.

The above embodiments cannot be construed to limit the scope of the present disclosure. Those skilled in the art should understand that, various modifications, combinations, sub-combinations, and substitutions can be made depending on design requirements and other factors. Any modifications, substitutions and improvements made within spirit and principles of the present disclosure shall be included in the scope of the present disclosure.

What is claimed is:

1. A parking lot recommendation method, comprising:

determining a target area according to a destination when a vehicle using a navigation terminal approaches the destination, wherein, the target area include multiple candidate parking lots;

for each candidate parking lot, acquiring a parking difficulty level of the candidate parking lot corresponding to a present time period, wherein, the parking difficulty level is determined according to a first average parking time-consumption of the candidate parking lot corresponding to the present time period, and a second average parking time-consumption of the target area corresponding to the present time period, wherein the first average parking time-consumption represents an average time-consumption required for the vehicle to park in the candidate parking lot in the present time period, and the second average parking time-consumption represents an average time-consumption required for the vehicle to park in the target area in the present time period;

determining a score of the candidate parking lot according to the parking difficulty level, a number of present remaining parking spaces of the candidate parking lot, a walking distance from the candidate parking lot to the destination, and a driving distance from a present position of the vehicle to the candidate parking lot;

determining a target parking lot from the multiple candidate parking lots according to the scores of the multiple candidate parking lots; and returning parking lot information of the target parking lot to the navigation terminal.

2. The method of claim 1, wherein, determining the second average parking time-consumption, comprises:

determining the second average parking time-consumption according to the first average parking time-consumptions of respective candidate parking lots.

3. The method of claim 1, wherein, determining the first average parking time-consumption, comprises:

acquiring the first average parking time-consumption of the candidate parking lot corresponding to the present time period by querying pre-stored average parking time-consumptions of the candidate parking lot in respective time periods.

4. The method of claim 3, further comprising:

acquiring historical parking data of the candidate parking lot in respective time periods;

for each time period, determining a parking time-consumption required by the corresponding vehicle to park in the candidate parking lot according to the historical parking data of the candidate parking lot in the time period, wherein, the parking time-consumption is a time difference between an entry time point of the corresponding vehicle entering the candidate parking lot and a parking time point of the corresponding vehicle completing parking in the candidate parking lot; and determining the average parking time-consumption of the candidate parking lot in the time period according to the parking time-consumptions of all vehicles parked in the time period.

5. The method of claim 4, wherein, the entry time point is uploaded by a parking lot terminal in the candidate parking lot, and the parking time point is uploaded by the navigation terminal when detecting that the corresponding vehicle completes the parking in the candidate parking lot.

6. The method of claim 1, wherein, determining the present time period comprises:

determining an estimated time point of the vehicle arriving at the destination, according to the present position of the vehicle;

determining the present time period, according to the estimated time point.

7. The method of claim 1, wherein, determining the second average parking time-consumption comprises:

querying pre-stored average parking time-consumptions of the target area in the respective time periods, acquiring the average parking time-consumption of the target area corresponding to the present time period to determine the second average parking time-consumption.

8. The method of claim 1, wherein, determining the second average parking time-consumption comprises:

determining the average parking time-consumption of the target area corresponding to the present time period to determine the second average parking time-consumption, according to historical parking data of the target area corresponding to the present time period.

9. The method of claim 1, wherein, determining the score of the candidate parking lot comprises:

determining the score of the candidate parking lot by performing a weighted summation on the parking difficulty level of the candidate parking lot, the number of the present remaining parking spaces of the candidate parking lot, the walking distance from the candidate parking lot to the destination, and the driving distance from the present position of the vehicle to the candidate parking lot.

10. The method of claim 1, wherein, determining the score of the candidate parking lot comprises:

determining the score of the candidate parking lot by inputting the parking difficulty level, the number of the present remaining parking spaces of the candidate parking lot, the walking distance from the candidate parking lot to the destination, and the driving distance from the present position of the vehicle to the candidate parking lot into a pre-trained scoring model.

11. The method of claim 1, wherein, acquiring the parking difficulty level of the candidate parking lot comprises:

determining the parking difficulty level of the candidate parking lot, according to a time difference between the first average parking time-consumption and the second average parking time-consumption.

12. A navigation server, comprising:

at least one processor; and a memory in communication connection with the at least one processor, wherein, the memory is stored with instructions executable by the at least one processor, when the instructions are executed by the at least one processor, a parking lot recommendation method is implemented, the parking lot recommendation method comprising:

determining a target area according to a destination when a vehicle using a navigation terminal approaches the destination, wherein, the target area include multiple candidate parking lots;

for each candidate parking lot, acquiring a parking difficulty level of the candidate parking lot corresponding to a present time period, wherein, the parking difficulty level is determined according to a first average parking time-consumption of the candidate parking lot corresponding to the present time period, and a second average parking time-consumption of the target area corresponding to the present time period, wherein the first average parking time-consumption represents an average time-consumption required for the vehicle to park in the candidate parking lot in the present time period, and the second average parking time-consumption represents an average time-consumption required for the vehicle to park in the target area in the present time period;

determining a score of the candidate parking lot according to the parking difficulty level, a number of present remaining parking spaces of the candidate parking lot, a walking distance from the candidate parking lot to the destination, and a driving distance from a present position of the vehicle to the candidate parking lot;

determining a target parking lot from the multiple candidate parking lots according to the scores of the multiple candidate parking lots; and returning parking lot information of the target parking lot to the navigation terminal.

13. The navigation server of claim 12, wherein, determining the second average parking time-consumption, comprises:

determining the second average parking time-consumption according to the first average parking time-consumptions of respective candidate parking lots.

14. The navigation server of claim 12, wherein, determining the first average parking time-consumption, comprises:

acquiring the first average parking time-consumption of the candidate parking lot corresponding to the present time period by querying pre-stored average parking time-consumptions of the candidate parking lot in respective time periods.

15. The navigation server of claim 14, further comprising:

acquiring historical parking data of the candidate parking lot in respective time periods;

for each time period, determining a parking time-consumption required by the corresponding vehicle to park in the candidate parking lot according to the historical parking data of the candidate parking lot in the time period, wherein, the parking time-consumption is a time difference between an entry time point of the corresponding vehicle entering the candidate parking lot and a parking time point of the corresponding vehicle completing parking in the candidate parking lot; and determining the average parking time-consumption of the candidate parking lot in the time period according to the parking time-consumptions of all vehicles parked in the time period.

16. The navigation server of claim 15, wherein, the entry time point is uploaded by a parking lot terminal in the candidate parking lot, and the parking time point is uploaded by the navigation terminal when detecting that the corresponding vehicle completes the parking in the candidate parking lot.

17. A parking lot recommendation method, comprising:

determining a target area according to a destination when a vehicle using a navigation terminal approaches the destination, wherein, the target area includes multiple candidate parking lots;

for each candidate parking lot, determining a score of the candidate parking lot according to scoring parameters of the candidate parking lot, wherein, the scoring parameters include a first average parking time-consumption of the candidate parking lot corresponding to a present time period, and a second average parking time-consumption of the target area corresponding to the present time period, wherein the first average parking time-consumption represents an average time-consumption required for the vehicle to park in the candidate parking lot in the present time period, and the second average parking time-consumption represents an average time-consumption required for the vehicle to park in the target area in the present time period;

determining a target parking lot from the multiple candidate parking lots according to the scores of the multiple candidate parking lots; and returning parking lot information of the target parking lot to the navigation terminal.

18. The method of claim 17, wherein, the scoring parameters further include at least one of a number of present remaining parking spaces in the candidate parking lot, a walking distance from the candidate parking lot to the destination, and a driving distance from a present position of the vehicle to the candidate parking lot.

19. The method of claim 17, wherein, determining the score of the candidate parking lot comprises:

obtaining the score of the candidate parking lot by performing weighted summation on the first average parking time-consumption, the second average parking time-consumption, the number of the present remaining parking spaces of the candidate parking lot, the walking distance from the candidate parking lot to the destination, and the driving distance from the present position of the vehicle to the candidate parking lot.

20. The method of claim 17, wherein, the first average parking time-consumption of the candidate parking lot corresponding to the present time period is acquiring by querying pre-stored average parking time-consumptions of the candidate parking lot in respective time periods.

* * * * *